United States Patent [19]

Birjukova et al.

[11] 3,936,689

[45] Feb. 3, 1976

[54] ROTARY ANODE FOR POWER X-RAY TUBES AND METHOD OF MAKING SAME

[76] Inventors: Tatyana Anatolievna Birjukova, ulitsa Kropotkinskaya, 13, kv. 17; Nikolai Ivanovich Freze, ulitsa Fersmana, 5, kv. 13; Alexei Alexeevich Schukin, 2 Kolobovsky pereulok 14, kv. 28; Anatoly Vasilievich Abalikhin, ulitsa Amurskaya, 21, korpus 3, kv. 52; Mikhail Vasilievich Maltsev, ulitsa Streletskaya, 26a, kv. 40; Nikolai Nikolaevich Evgrafov, ulitsa Kolenchataya, 13/17, kv. 4, all of Moscow; Sergei Gavrilovich Semenov, ulitsa Lomonosova, 26, kv. 17, Leningrad; Valentina Pavlovna Zhukova, Moskovskoe shosse, 36, kv. 29, Leningrad; Maria Ilinichna Teumin, ulitsa Grazhdanskaya, 112, korpus 2, kv. 87, Leningrad; Veronika Vasilievna Isaichenko, ulitsa Kronverkskaya, 25, kv. 32, Leningrad; Mikhail Minovich Nerodenko, ulitsa Observatornaya, 8, kv. 8, Kiev; Galina Nikolaevna Alexeenko, ulitsa Dovnar-Zapolskogo, 8, kv. 86, Kiev; Alexei Fedorovich Tetervak, ulitsa Volodarskogo, 22, kv. 9, Kiev; Samuil Mordkovich Gurevich, ulitsa Lesi Ukrainki, 2, kv. 2, Kiev; Grigory Vasilievich Tjukalov, Varshavskoe shosse, 18, korpus 2, kv. 241, Moscow; Georgy Vladimirovich Kurganov, ulitsa Lipetskaya 26, kv. 144, Moscow, all of U.S.S.R.

[22] Filed: Jan. 10, 1974

[21] Appl. No.: 432,330

[52] U.S. Cl. ..... 313/330; 313/55; 29/25.17

[51] Int. Cl.[2] ..... H01J 35/08

[58] Field of Search ..... 313/330, 55; 29/25.17

[56] References Cited

UNITED STATES PATENTS

| | | | |
|---|---|---|---|
| 3,579,022 | 5/1971 | Hennig et al. | 313/330 |
| 3,697,798 | 10/1972 | Wagner et al. | 313/330 |

*Primary Examiner*—Saxfield Chatmon, Jr.
*Attorney, Agent, or Firm*—Haseltine, Lake & Waters

[57] ABSTRACT

An anode is disclosed characterized in that its body is made from molten molybdenum or an alloy based thereon, while the working coating of the anode, exposed to electron bombardment, is built up of a tungsten-rhenium alloy.

Disclosure is also made of a method for making an anode, consisting in that the blank for the anode body is made by melting molybdenum or an alloy based thereon under vacuum or in an inert gas medium, while the working coating is built up on the respective anode surface in layers.

5 Claims, 1 Drawing Figure

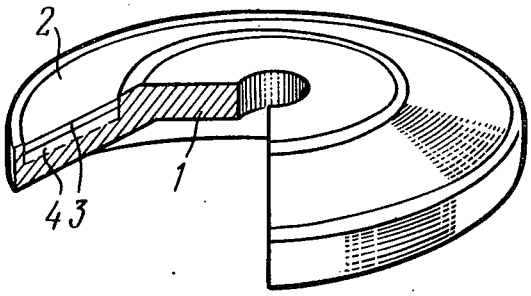
2
1
4 3

ROTARY ANODE FOR POWER X-RAY TUBES AND METHOD OF MAKING SAME

The present invention relates to X-ray technique, and more particularly to rotary anodes for diagnostic power X-ray tubes and methods for making same.

An increase in the intensity of electronic bombardment of the anode working surface, associated with increased power of X-ray tubes, has resulted in an increase in the rotational speed of the anode to 9,000 rpm and calls for the use of materials possessing higher heat capacity, heat resistance, under conditions of high-amplitude thermal cycles, and lower specific gravity, as compared to tungsten commonly employed in low-power X-ray tubes.

This tendency has given rise to combined bimetallic anodes with their bodies being made from molybdenum or alloys based thereon and the working surfaces exposed to electron bombardment being made from tungsten or alloys thereof with rhenium. Widely known are anodes the working layer whereof is made from a tungsten-rhenium alloy with an invariable composition throughout the whole thickness of the working layer, as well as anodes in which the content of tungsten and rhenium diminishes with depth, while the content of molybdenum, on the contrary, increases reaching its maximum in the core of the anode body. The above-mentioned bimetallic anodes are fabricated by methods employed in powder metallurgy.

A major disadvantage of the known bimetallic anodes is their short service life. As a rule, the service life of such anodes does not exceed 15,000 on-off cycles. Practically, in the course of operation after the above number of on-off cycles, the anode starts to split, the surface layer disintegrates and the anode is eventually deformed, to say nothing of the deterioration of the working vacuum.

The splitting of the anode is due to an insufficiently strong cohesion between the metals of the working layer and the anode body.

In turn, poor metallic cohesion, fast disintegration of the working layer, deformation of the anode, etc., are accounted for by the fact that the anode as a whole is fabricated by methods of powder metallurgy. These methods are disadvantageous in that they are bound to involve the presence of gas and metallic inclusions in the anode body and in the working layer thereof.

By metallic inclusions are here meant metals with a comparatively low melting point. In the course of operation, as the anode is subjected to elevated temperatures, the above inclusions vigorously evaporate, which, naturally, results in a rapid disintegration of the anode as has been mentioned above.

The principal object of the invention, therefore, is to provide anodes capable of standing up to high-amplitude thermal cycles without being disintegrated, and maintaining the required X-ray intensity for periods covering at least 20,000 on-off cycles.

Consequently, it is an object of the present invention to increase the service life of anodes.

Another objects of the invention is to provide a method for making anodes for X-ray tubes, possessing improved characteristics.

These objects are attained by that a rotary anode for power X-ray tubes, made from molybdenum or alloys based thereon and having its surface, exposed to electron bombardment, coated with a tungsten-rhenium alloy and having a composition varying so that the content of rhenium diminishes and that of molybdenum increases with depth, is made, according to the invention, from molten molybdenum or an alloy based thereon, while the coating of the tungsten-rhenium alloy is obtained by building-up.

Specifically, the outer layer of the tungsten-rhenium alloy coating contains an invariable amount of rhenium.

The thickness of the layer containing an invariable amount of rhenium may be 0.2 to 0.5 mm with the total thickness of the whole coating being equal to no less than 0.7 mm.

The method of the present invention consists in that the blank for the anode is made by melting under vacuum or in an inert gas medium, while the coating of the tungsten-rhenium alloy is obtained by building it up in layers, also under vacuum or in an inert gas medium.

Specifically, the tungsten-rhenium alloy is built up in layers at least 0.2 mm thick.

Given below is a detailed description of the present invention with reference to a preferred embodiment thereof taken in conjunction with the accompanying drawing which is a partsectioned general view of an anode according to the present invention.

Referring now to the drawing, the anode consists of a body 1 and a coating 2 of a tungsten-rhenium alloy applied to the anode surface exposed to electron bombardment.

To save expensive rhenium, the coating 2 is recommended to be applied only to the width of the focal spot struck by electrons emitted by the cathode.

The body 1 of the anode is made from "soft" molybdenum or alloys based thereon. By soft molybdenum or alloy is meant molybdenum or an alloy which remains plastic after melting and crystallization that follows.

Used as the soft molybdenum alloy may be the widely known alloy of the following composition (in %): zirconium — 0.15 to 0.25, carbon — 0.01 to 0.06, nickel — 0.03 to 0.06, molybdenum — the rest. Any other molybdenum alloy possessing similar characteristics may be used as well.

The blank for the anode body 1 is made by melting under vacuum to ensure a high degree of refinement of the metal rendering it free from gaseous and metallic impurities. An inert gas medium may be used instead of vacuum.

The melted blank is rolled and formed until it assumes the shape of the anode body 1. Then, the surface of the anode body 1, which is exposed to electron bombardment, is coated with a tungsten-rhenium alloy.

The coating practically consists of two layers: the first, outer, layer 3 is 0.2 to 0.5 mm thick and is characterized by a virtually constant content of rhenium therein. Making the layer 3 thicker or thinner than the above value is undesirable. If the layer 3 is too thin, molybdenum may appear on the surface, which will result in a deterioration of the X-ray tube performance, namely in a lower intensity of X-radiation; if the layer 3 is too thick, an excessive amount of rhenium will be expended, which is highly undesirable taking into consideration its high cost.

The second layer 4 is intermediate between the layer 3 and the anode body 1. This layer is at least 0.5 mm thick. Making the layer 4 thinner than that will result in a poorer metallic cohesion between the working coating 2 and the anode body 1, as well as in a sharp increase in internal stresses in the region of contiguity of different metals.

The content of metals in the layer 4 varies with depth, the content of rhenium diminishing and that of molybdenum increasing. Therewith, the content of rhenium varies from maximum, in the layer 3, to minimum, in the body 1 where it is present in the form of mere traces. The content of molybdenum varies in the same manner, only in the opposite direction, i.e., from the core to the surface layer.

The total thickness of the working layer 2 may be regarded as a sum of thicknesses of the layers 3 and 4. Usually, the thickness of the working layer 2 is equal to at least 0.7 mm. Making the working layer 2 thicker than 1.3 mm is undesirable for, as has already been mentioned above, it involves an unduly high expenditure of rhenium.

Making the working layer 2 thinner, on the other hand, impairs the quality of the anode in a manner described above.

The coating 2 is obtained by building the tungsten-rhenium alloy up in layers upon a respective surface of the anode body 1. Building-up is effected in layers each at least 0.2 mm thick. Making said layers thinner than 0.2 mm with the total thickness of the coating 2 being equal to no more than 1.3 mm results in that molybdenum appears on the working surface of the anode.

The working layer is built up under vacuum or in an inert gas medium for the reasons given above in connection with the melting of a blank for the anode body.

Building-up is performed by electron-beam, argon-arc or plasma-arc welding in layers in the form of circular seams as wide as the focal spot of the anode which is preheated for the purpose to a temperature of 1,000° to 1,500°C, for example, by means of a defocused electron beam or any other appropriate method known per se. In so doing, the surface layer of the molybdenum alloy is brought to a molten state to enhance cohesion of heterogeneous metals.

The first layer of the built-up tungsten-rhenium alloy 0.2 to 0.5 mm thick ensures proper fusion of metals forming, as a result, molybdenum-tungsten-rhenium alloys of a variable composition. The second, third and other layers having a total thickness of 0.3 to 0.5 mm take up the layer 3 of an invariable rhenium content, determining the operating characteristics of the anode.

The anodes thus made feature high reliability and a long service life. Experimental data indicate that such anodes can withstand more than 20,000 on-off cycles and are characterized by an extremely low content of gaseous and metallic impurities, which permits to obviate the necessity for costly and time-consuming operations of degassing the anode prior to assembling the X-ray tube.

Used for building-up the working layer may be tungsten-rhenium alloys of any known composition employed hereto in coating X-ray tube anodes.

Given below are examples of anodes made according to the present invention and their characteristics.

Anode 1

The total thickness of the tungsten-rhenium alloy coating is 1 mm. The outer layer having an invariable content of rhenium (27 percent) is 0.3 mm thick. The intermediate layer between the outer layer having an invariable rhenium content and the anode body is 0.7 mm thick.

This layer is characterized in that molybdenum is present therein whose content diminishes to zero in the surface layer, while the content of rhenium diminishes from 27 percent in the surface layer to mere traces in the anode body.

This anode was made by building up a tungsten-rhenium alloy containing 27 percent of rhenium on the respective surface of its body. The body was made by melting a molybdenum alloy, having the composition mentioned above in the descriptive part, under vacuum.

The tungsten-rhenium coating was built up in layers 0.3 to 0.4 mm thick.

28,000 on-off cycles were performed with the anode rotating at a speed of 9,000 rpm at a working temperature of about 1,700°C. The anode proved to be stable in operation under these conditions.

Anode 2

The total thickness of the coating of a tungsten-rhenium alloy is 0.9 mm.

The outer layer with an invariable content of rhenium (20.1 percent) is 0.3 mm thick.

The thickness of the intermediate layer similar to that of Anode 1 is 0.6 mm.

The tungsten-rhenium coating was built up in layers 0.3 to 0.4 mm thick on the anode body made in a manner like and having a composition similar to that of Anode 1.

22,000 on-off cycles were performed with the anode rotating at a speed of 9,000 rpm at a working temperature of 1,700°C.

The operation of the anode remained stable throughout the test.

What is claimed is:

1. A rotating anode for X-ray tubes, comprising a body of melted metal selected from the group consisting of molybdenum and alloys based thereon and a composite coating of tungsten-rhenium alloy, said anode having a composition varying so that an outer layer of tungsten-rhenium has constant rhenium content followed by a layer of tungsten-rhenium-molybdenum alloys with the content of rhenium decreasing towards the interior and the content of molybdenum increasing.

2. An anode as of claim 1, wherein the content of rhenium in the surface layer of the tungsten-rhenium alloy coating is invariable.

3. An anode as defined in claim 2, wherein the thickness of the layer with constant rhenium content is from 0.2 to 0.5 mm while the total thickness of coating is from 0.7–1.3 mm.

4. A method for producing a rotary anode for power X-ray tubes, comprising the steps of melting a blank for the anode body under vacuum, rolling said blank, forming the anode body and overlay welding a coating of a tungsten-rhenium alloy on the anode surface exposed to electron bombardment in layers under vacuum.

5. A method according to claim 4, whereby the tungsten-rhenium alloy coating is overlay welded in layers of at least 0.2 mm thick.

* * * * *